United States Patent [19]

Nakamura

[11] 4,217,057

[45] Aug. 12, 1980

[54] PRINTER PAPER FEED ASSEMBLY INCLUDING MEANS FOR FACILITATING MANUAL PAPER ADVANCE

[75] Inventor: Osamu Nakamura, Shiojiri, Japan

[73] Assignee: Kabushiki Kaisha Suwa Seikosha, Tokyo, Japan

[21] Appl. No.: 872,416

[22] Filed: Jan. 26, 1978

[30] Foreign Application Priority Data

Jan. 26, 1977 [JP] Japan ..... 52-7415

[51] Int. Cl.[2] ..... B41J 13/02

[52] U.S. Cl. ..... 400/636; 400/567; 400/569; 400/577; 400/636.1; 400/636.2

[58] Field of Search ..... 400/565, 567, 569, 577, 400/636, 636.1, 636.2; 74/337.5, 339, 435, 436, 437

[56] References Cited

U.S. PATENT DOCUMENTS

| | | | |
|---|---|---|---|
| 1,133,004 | 3/1915 | Carlin | 400/569 X |
| 1,161,514 | 11/1915 | Ocumpaugh | 400/636 X |
| 1,853,761 | 4/1932 | Degener | 400/636 X |
| 2,797,589 | 7/1957 | Chaveneaud | 74/436 |
| 2,978,919 | 4/1961 | Petit | 74/435 |
| 3,001,159 | 9/1961 | Hilsinger | 74/436 X |
| 3,122,946 | 3/1964 | Hedges | 74/437 X |
| 3,260,128 | 7/1966 | Gassino et al. | 74/435 |
| 3,650,156 | 3/1972 | Thomas | 74/436 X |
| 3,749,221 | 7/1973 | Busch | 400/569 X |
| 3,765,651 | 10/1973 | Lifferth | 74/437 X |
| 3,840,107 | 10/1974 | Mack et al. | 400/636 X |
| 4,090,410 | 5/1978 | Nakamura | 74/435 X |

FOREIGN PATENT DOCUMENTS

| | | | |
|---|---|---|---|
| 188227 | 1/1957 | Fed. Rep. of Germany | 74/339 |
| 471047 | 5/1952 | Italy | 400/636 |
| 940828 | 11/1963 | United Kingdom | 400/637.4 |

*Primary Examiner*—Ernest T. Wright, Jr.
*Attorney, Agent, or Firm*—Blum, Kaplan, Friedman, Silberman & Beran

[57] ABSTRACT

A paper feed assembly for a printer which permits manual paper advance includes a pair of rotatable rollers for advancing a print paper therebetween, a paper feed gear mounted on one roller and a drive gear alternately operatively engaged with the paper feed gear. The drive gear includes a paper feed portion for incrementally rotating the paper feed gear for advance of the print paper and a drive portion for effecting proper alignment of the paper feed gear and drive gear prior to paper advancement.

8 Claims, 13 Drawing Figures

PRINTER PAPER FEED ASSEMBLY INCLUDING MEANS FOR FACILITATING MANUAL PAPER ADVANCE

BACKGROUND OF THE INVENTION

This invention relates generally to a paper feed assembly for a printer, and particularly to a paper feed assembly permitting unrestricted manual displacement of the print paper in two directions. In many printer paper feed assemblies, manual paper extraction is possible, however, gear engagement in the driving mechanism imposes substantial drag on the paper. In these cases, substantial force is required to extract the paper which often results in the paper tearing. In addition, noise is substantial and lag in the pitch of the paper often occurs. Accordingly, it is desirable to provide a paper feed assembly which facilitates extraction of paper in either of two directions.

SUMMARY OF THE INVENTION

Generally speaking, in accordance with the invention, a paper feed assembly for use in a printer having a manual paper advance feature is provided. The assembly includes a paper feed roller and a paper feed gear mounted on a rotatable shaft and a compression roller for advancing a print paper tape therebetween. A drive gear having a first paper feed section formed with an index tooth for alternatively rotating the paper feed gear and second drive section for aligning the paper feed gear into proper position for engagement with the index tooth. Provision for positioning the paper feed gear may be by an auxiliary gear formed with a reset tooth driven by the drive gear for realigning the paper feed gear. In another embodiment, positioning of the paper feed gear is by a drive gear formed with camming cam surfaces and a paper feed gear formed with positioning teeth for selective engagement with the camming surfaces.

Accordingly, it is an object of the invention to provide an improved paper feed assembly.

Another object of the invention is to provide an improved paper feed assembly including provision for unrestricted manual displacement of paper in two directions between printing operations.

A further object of the invention is to provide an improved paper feed assembly for eliminating lag in pitch of the paper.

Still another object of the invention is to provide an improved paper feed assembly with reduced load on the paper during manual displacement of the paper.

Still a further object of the invention is to provide an improved paper feed assembly with reduced noise during manual displacement of paper in two directions.

Another object of the invention is to provide an improved feed assembly having a minimal number of parts, easily constructed and of good reliability.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWING

For a fuller understanding of the invention, reference is had to the following description taken in connection with the accompanying drawing, in which.

DESCRIPTION OF THE PREFERRED EMBODIMENTS

Figure 1:
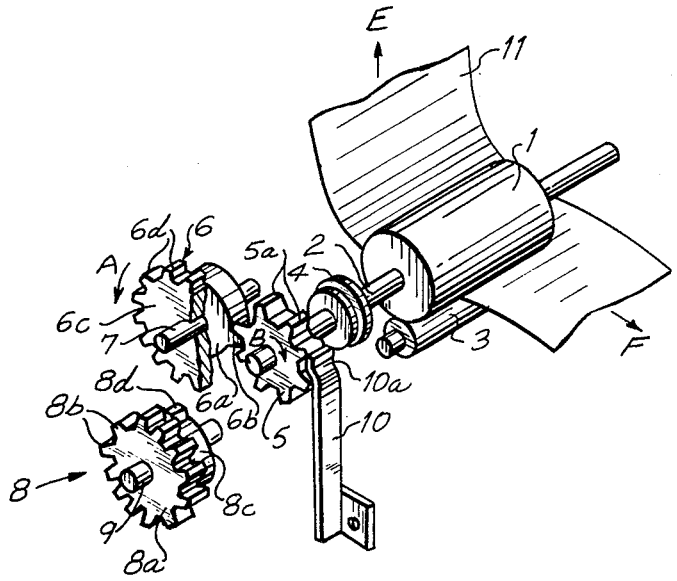
FIG. 1 is a partially exploded perspective view of a paper feed assembly constructed and arranged in accordance with an embodiment of the invention.

Referring now to FIG. 1, a paper feed assembly for a printer constructed and arranged in accordance with the invention is shown in partial exploded perspective. The paper feed assembly includes a paper feed roller 1 mounted on a paper roller shaft 2 which is rotatably supported on the printer by a shaft bearing 4. A support roller 3, positioned to contact paper feed roller 1 for feeding a print paper 11 therebetween, is rotatably mounted on the printer. A paper feed gear 5 formed with a plurality of paper feed teeth 5*a* equally spaced about the circumference thereof is fixed to one end of paper roller shaft 2.

Print paper 11 is shown positioned between paper feed roller 1 and support roller 3 and is incrementally advanced in a normal feed direction indicated by an arrow E when paper feed gear 5 is rotated in the clockwise direction as indicated by an arrow B. Print paper 11 may be extracted manually from the paper feed assembly in a normal feed direction E or in a direction opposite to normal feed direction E as indicated by an arrow F.

A drive gear shown generally as 6 is formed with a first paper feed section 6*a* formed with an index tooth 6*b* and a second drive section 6*c* formed with a plurality of drive teeth 6*d* equally spaced about the circumference thereof. Drive gear 6 is mounted on a drive shaft 7 rotatably mounted on the printer so that index tooth 6*b* may engage one index tooth 5*a* during each revolution of drive gear 6 for the incremental feeding of print paper 11 in normal feed direction E and for the operative engagement between drive section 6*c* and an auxiliary gear shown generally as 8. Auxiliary gear 8 is mounted on an auxiliary shaft 9 which is rotatably mounted on the printer. Auxiliary gear 8 is formed with a first driven section 8*a* formed with a plurality of auxiliary teeth 8*b* equally spaced about the circumference thereof for engagement with drive teeth 6*d* and is formed further with a second drive section 8*c* formed with a reset tooth 8*d* for selective engagement with paper feed gear 5. Auxiliary gear 8 is rotated about shaft 9 in the direction indicated by an arrow C when drive gear 6 is rotated in arrow direction A for the incremental advancing of print paper 11. Auxiliary gear 8 is positioned on the printer so that reset tooth 8*d* engages one index tooth 5*a* which may be in its locus of rotation when paper feed gear 5 is not in a standby position for engagement by index tooth 6*b* of drive gear 6 as will be described in more detail with respect to FIGS. 3 and 4.

Figure 2:
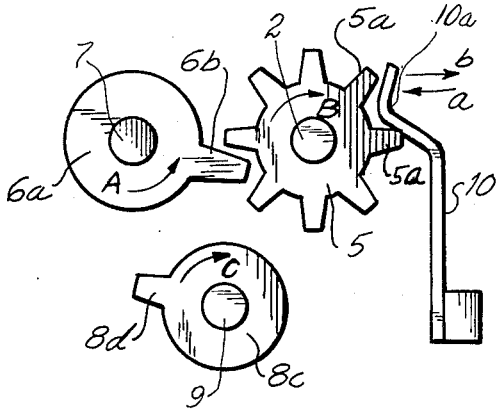
FIG. 2 is a side elevational operational view illustrating the paper feed assembly illustrated in FIG. 1 during normal paper advance.
Figure 4:
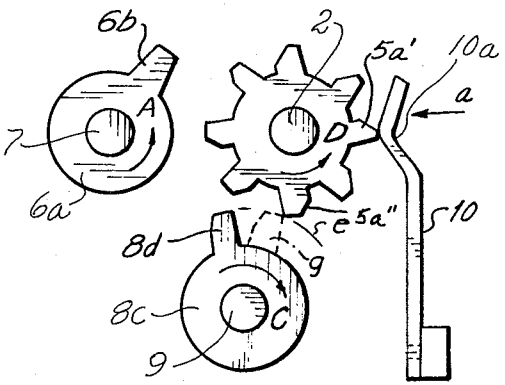
FIG. 4 is a side elevational operational view illustrating the paper feed assembly illustrated in FIG. 1 just prior to repositioning of the elements after manual displacement of paper.

An elongated position plate spring 10 is mounted on the printer at its first end and is formed with a curved portion 10*a* at its second end for biasing against paper feed gear 5 for maintaining the rotational position of paper feed gear 5. Paper feed gear 5 may be in a standby position as indicated in FIG. 2 wherein position plate spring 10 engages paper feed gear 5 between two adjacent paper feed teeth 5*a*, or in a random position as indicated in FIG. 4 wherein position plate spring 10 is engaged with the tip of a paper feed tooth 5*a*'. This random position of paper feed gear 5 may occur when print paper 11 has been extracted or advanced manually.

Drive gear 6 may be rotated in arrow direction A for normal paper advance direction E by means of a motor (not shown) which may be operatively coupled directly to drive shaft 7 or to drive teeth 6*d* of drive gear 6.

Figure 3:
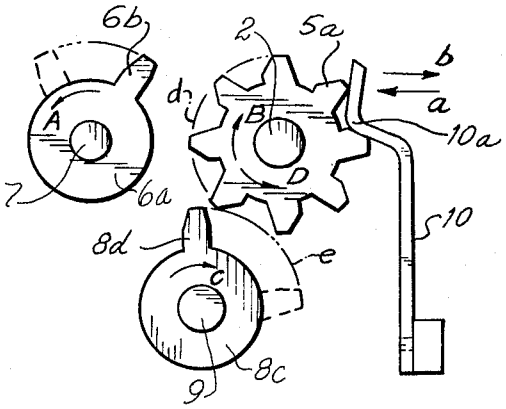
FIG. 3 is a side elevational operational view illustrating the paper feed assembly illustrated in FIG. 1 as paper is displaced manually.

Referring now to FIGS. 2–4, side elevational operational views of the gearing arrangement of the paper feed assembly illustrated in FIG. 1 are shown. Print paper 11 is fed incrementally in normal feed direction E as paper feed teeth 5*a* are rotated one tooth at a time in arrow direction B by index tooth 6*b* each time drive gear 6 is rotated one revolution about drive shaft 7 in arrow direction A. As paper feed gear 5 is rotated incrementally in arrow direction B, position plate spring 10 is displaced between its first position towards paper feed gear 5 in the direction indicated by an arrow a and its second position away from paper feed gear 5 in the direction indicated by an arrow b due to the rotating force of paper feed teeth 5*a* against positioning plate spring 10. When paper feed gear 5 has been rotated incrementally index teeth 5*a* are positioned in a standby position with concave portion 10*a* of positioning plate spring 10 biased between two adjacent paper feed teeth 5*a* in the direction indicated by arrow a.

Referring now to FIG. 3, when print paper 11 is advanced in this manner, paper feed teeth 5*a* are maintained in this standby position outside the rotating locus of reset tooth 8*d* indicated as e by positioning plate spring 10. When index tooth 6*b* is located outside the rotating locus of paper feed teeth 5*a* indicated as d, that is in all positions other than paper feed and immediately prior thereto, paper feed teeth 5*a* may be freely rotated in the directions indicated by arrows B and D. Accordingly, at this time when paper feed gear 5 is not being driven by drive gear 6, print paper 11 may be manually displaced in normal feed direction E or opposite direction F as shown in FIG. 1. When print paper 11 is pulled, paper feed roller 1 and paper feed shaft 2 are rotated and positioning plate spring 10 is forced towards its second position in arrow direction b by paper feed teeth 5*a* of paper feed gear 5.

When print paper 11 is manually displaced, a problem may arise when paper feed gear 5 comes to rest in a random position not in its standby position as indicated in FIGS. 2 and 3. In this random position illustrated in FIG. 4, curved portion 10*a* of positioning plate spring 10 does not engage paper feed gear 5 between adjacent paper feed teeth 5*a*, instead, positioning plate spring 10 is biased against the end of one paper feed tooth 5*a*'. This random positioning of paper feed gear 5 makes it difficult to perfrom the desired incremental paper feeding evenly and results in a lag of pitch of print paper 11. In addition, damage may occur to the tops of paper feed teeth 5*a* when engaged by rotating index tooth 6*b*.

This random positioning of paper feed gear 5 is avoided in accordance with the invention by positioning auxiliary gear 8 on the printer so that reset tooth 8*d* will engage one paper feed tooth 5*a*'' resting within rotating locus e of auxiliary gear 8 when paper feed gear 5 is in a random position. Auxiliary gear 8 is rotated in arrow direction C by drive gear 6 and when reset tooth 8*d* reaches the position indicated in phantom as g, will engage paper feed tooth 5*a*'' causing paper feed gear 5 to rotate in arrow direction D until paper feed gear 5 is positioned in its standby position. Positioning plate spring 10 will engage paper feed gear 5 between adjacent paper feed teeth 5*a* and paper feed gear 5 is maintained in this proper standby position by the biasing action of positioning plate spring 10. This reset operation permits accelerated paper advance by pulling print paper 11 in normal feed direction E and opposite direction F without concern whether paper feed gear 5 will come to rest on a proper standby position. If desired, a manual feed knob may be mounted on roller shaft 2 for effecting accurate manual advancement of print paper 11 and for facilitating initial paper insertion as will be described with respect to the later embodiments of the invention.

Figure 5:
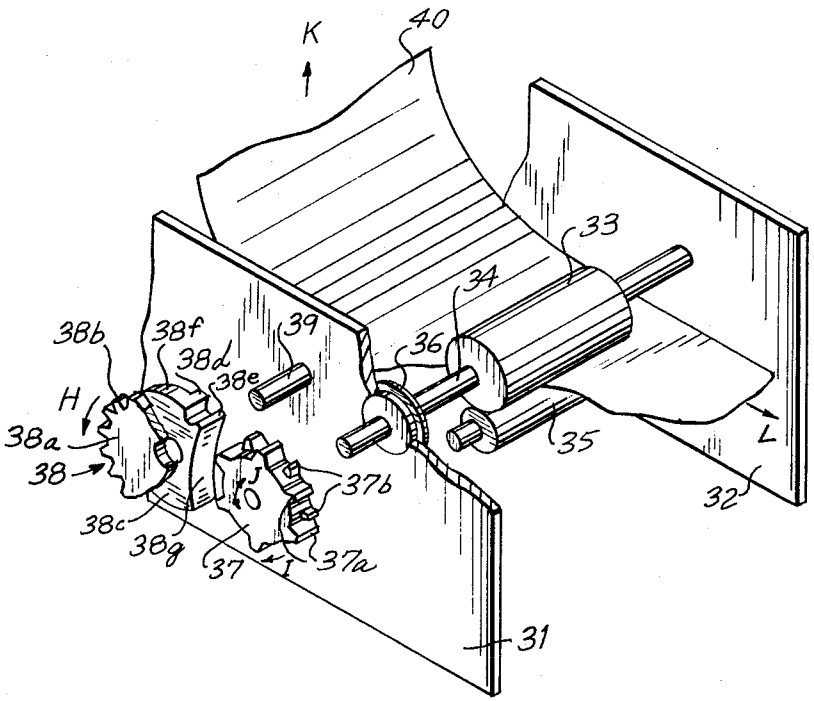
FIG. 5 is a partially exploded perspective view of a paper feed assembly constructed and arranged in accordance with another embodiment of the invention.

Referring now to FIG. 5, a paper feed assembly for a printer constructed and arranged in accordance with another embodiment of the invention is shown in partial exploded perspective. In this embodiment, the paper feed gear reset operation is performed by the driving member. The paper feed assembly includes a frame including a first frame side wall 31 and a second frame side wall 32. A paper feed roller 33 is mounted on a paper roller shaft 34 which is rotatably mounted on frame walls 31 and 32 by a shaft bearing 36 secured to frame wall 31. A support roller 35 is rotatably mounted to the frame and is positioned to engage paper feed roller 33 for feeding a print paper 40 therebetween. A paper feed gear 37 is mounted on the end of paper roller shaft 34 outside first side wall 31 of the frame.

Paper feed gear 37 is formed with a plurality of positioning teeth 37*a* equally spaced about the circumference of paper feed gear 37 and formed across the entire surface thereof. Paper feed gear 37 is formed further with a plurality of paper feed teeth 37*b* formed across a portion of the circumferential surface of paper feed gear 37 and equally spaced about the circumference of paper feed gear 37 and positioned alternately between adjacent positioning teeth 37*a*.

A drive gear shown generally as 38 is mounted on a drive shaft 39 which is rotatably mounted on first frame side wall 31. Drive gear 38 is formed with a first driven section 38*a* formed with a plurality of drive teeth 38*b* equally spaced about the circumference of driven section 38*a*. Drive gear 38*b* is formed further with a second driving section 38*c* having a smaller diameter than first driving section 38*a* and is formed with a first index tooth 38*d* and a second index tooth 38*e* for meshing engagement with one positioning tooth 37*a* or one paper feed tooth 37*b* on paper feed gear 37, a circular positioning cam 38*f* extending about a portion of the circumference of drive gear 38 from first index tooth 38*d* to a concave cam section 38*g* for releasing engagement between drive gear 38 and paper feed gear 37. Circular positioning cam 38*g* is adapted for riding in camming fashion between two adjacent positioning teeth 37*a* adjacent to paper feed tooth 37*b* intermediate these two positioning teeth 37*a*.

Drive gear 38 may be rotated in a counterclockwise direction indicated by an arrow H for normal paper feed direction as indicated by an arrow K by means of a motor and driving gear (not shown). When drive gear 38 is rotated in arrow direction H, paper feed gear 37 is rotated incrementally in the direction indicated by an arrow I for incrementally feeding print paper 40 between paper feed roller 33 and support roller 35 in normal paper feed direction K. By constructing and arranging paper feed gear 37 and drive gear 38 in the manner described, print paper 40 may be advanced in normal paper feed direction K or in an opposite direction thereto as indicated by an arrow L when paper feed gear 37 is not engaged with drive gear 38. The operation of the paper feed assembly of this embodiment will be described with reference to the operational drawing of FIGS. 6–11.

Figure 6:
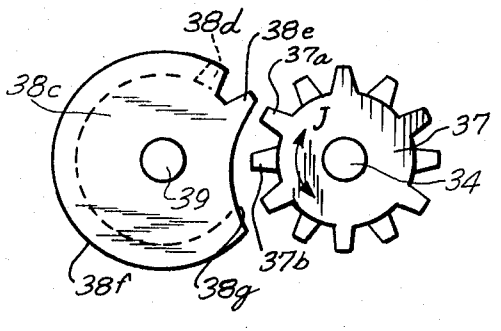
FIG. 6 is a side elevational operational view of the paper feed assembly illustrated in FIG. 5 at standby position.

Referring now to FIG. 6, the normal standby position of paper feed gear 37 when it is not engaged with drive gear 38 is shown thereby permitting the free rotation of paper feed gear 37 in the clockwise or counterclockwise direction as indicated by an arrow J. Thus, print paper 40 can be pulled out in either normal feed direction K or in opposite direction L as shown in FIG. 5. The load on print paper 40 is very light as the resistance to manual paper advance is caused only by the friction of the bearing members and the compression of support roller 35 against paper feed roller 33 and the friction at paper guiding portions so there is little possibility that print paper 40 will be torn. In addition, machine noise when print paper 40 is being pulled out is minimal.

As noted with respect to the foregoing embodiment of the invention, the rotational position of paper feed gear 37 immediately after print paper 40 has been displaced manually may present a problem when positioning teeth 37*a* or paper feed teeth 37*b* are engaged by index teeth 38*d* and 38*e* if paper feed gear 37 is at a random position other than the proper standby position. This problem is overcome in this embodiment of the invention by resetting the rotational position of paper feed gear 37 prior to the next incremental rotation of paper feed gear 37. This resetting of paper feed gear 37 is accomplished by first index tooth 38*d* and positioning cam 38*f* of drive gear 38 which will be described in detail with respect to FIGS. 7–9.

Figure 7:
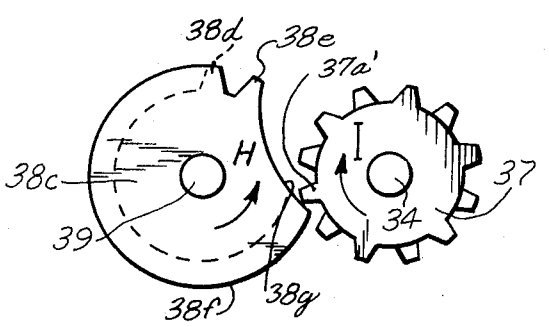
FIG. 7 is a side elevational operational view of the paper feed assembly illustrated in FIG. 6 is a non-standby position.
Figure 8:
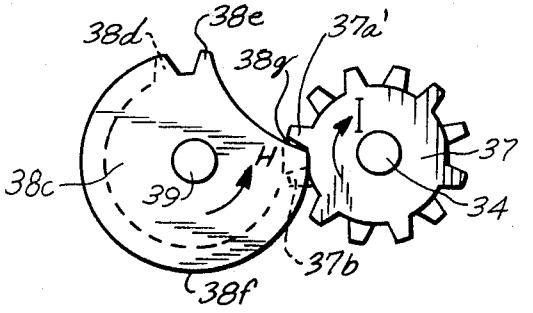
FIG. 8 is a side elevational operational view of the paper feed assembly illustrated in FIG. 5 as it is placed into position for paper advance.
Figure 9:
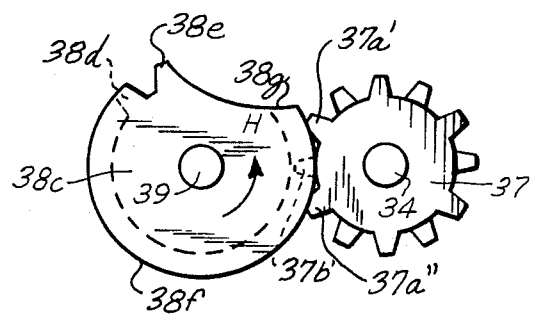
FIG. 9 is a side elevational operational view of the paper feed assembly illustrated in FIG. 5 firmly in standby position for paper advance.

Referring specifically to FIGS. 7 and 8, the rotational position of paper feed gear 37 and drive gear 38 is shown in a random non-standby position. In this position, as drive gear 38 rotates in the counterclockwise direction H, positioning tooth 37*a*′ in the rotational locus of concave cam portion 38*g* is engaged thereby and paper feed gear 37 is rotated in the clockwise direction as indicated by arrow I. Paper feed gear 37 is rotated through the relative position shown in FIG. 8 only to the standby position as indicated in FIG. 9. At this time positioning cam 38*f* of drive gear 38 rides between adjacent positioning teeth 37*a*′ and 37*a*″ and alongside paper feed tooth 37*b*′ shown in phantom in FIG. 9. This camming action between positioning cam 38*f* and paper feed gear 37 stops the rotation of paper feed gear 37 and firmly maintains the position in the standby position of paper feed gear 37 and paper feed roller 33 during the print cycle. In addition, paper feed gear 37 is ready for the next incremental paper advance and print cycle.

Figure 10:
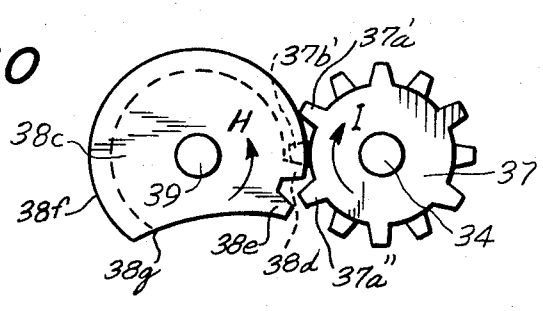
FIG. 10 is a side elevational operational view of the paper feed assembly illustrated in FIG. 5 in normal paper feed position after printing when paper feed has commenced.
Figure 11:
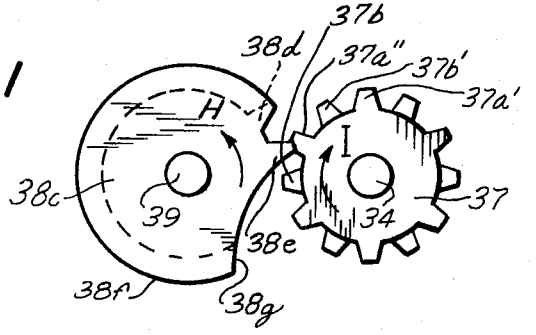
FIG. 11 is a side elevational operational view of the paper feed illustrated in FIG. 5 just before paper feed is completed.

After a print cycle is completed, normal incremental paper feeding commences as shown in FIG. 10. Paper feed gear 37 is maintained in normal print position by positioning cam 38*f* until one paper feed tooth 37*b*′ is engaged by the leading edge of first index tooth 38*d* whereby paper feed gear 37 is rotated in arrow direction I. At this time the next positioning tooth 37*a*″ is engaged between first index tooth 38*d* and second index tooth 38*e* and paper feed gear 37 is rotated firmly and accurately for the incremental advance of print paper 40. Rotation of paper feed gear 37 in arrow direction I is continued until positioning tooth 37*a*″ is freed from engagement with second index tooth 38*e* as shown in FIG. 11. At this time paper feed gear 37 is opposed to concave cam 38*g* and is freed from any engagement with drive gear 38. This is the normal standby position of paper feed gear 37 as indicated in FIG. 6.

As discussed with respect to FIG. 6, during standby when paper feed gear 37 is opposed to concave cam 38*g*, print paper 40 may be advanced manually in normal paper feed direction K or in opposite direction L freely. Prior to the next print cycle, drive gear 38 is rotated in arrow direction H so as to engage positioning cam 38*f* with paper feed gear 37 for firmly holding paper feed gear 37 and paper feed roller 33 during the print cycle as indicated in FIG. 9. Accordingly, the normal sequence of operation during normal incremental paper feeding without manual advance may be represented by the cycle of FIGS. 6 to 9 to 10 to 11 to 6, etc. In the case where paper 40 is advanced or extracted manually so as to place paper feed gear 37 in a random position, the cycle is as follows, from FIGS. 6 to 7 (or 8) to 9 to 10 to 11 to 6, etc.

Figure 12:
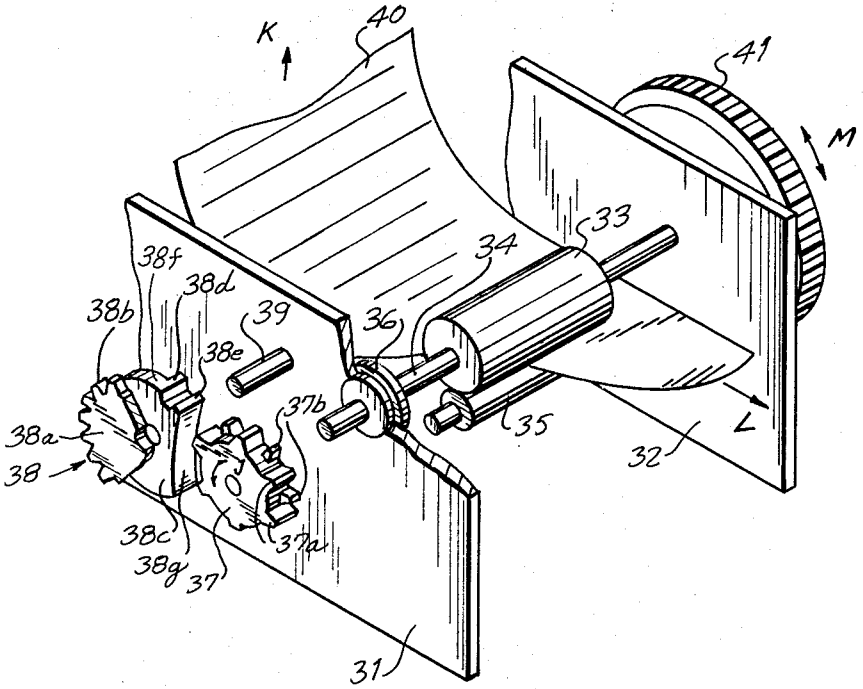
FIG. 12 is partially exploded perspective view of a paper feed assembly including manual feed knob constructed and arranged in accordance with the embodiment of the invention illustrated in FIG. 5.

Referring now to FIG. 12, a further embodiment of the paper advance assembly including a manual paper feed knob 41 constructed and arranged in accordance with the invention is shown in partially exploded perspective. Like elements in this embodiment are described by like reference numerals with respect to the embodiment depicted in FIG. 5. Manual paper feed knob 41 is mounted on roller shaft 34 at the end opposite to paper feed gear 37. Manual feed knob 41 permits rotation of roller shaft 34 in both normal feed direction K and opposite direction L as indicated by an arrow M for facilitating insertion of paper 40 and increasing the speed of manual displacement of print paper 40. This manual displacement by turning manual feed knob 41 may be performed freely when paper feed gear 37 and drive gear 38 are in standby position as indicated by the operational view illustrated in FIG. 6.

Figure 13:
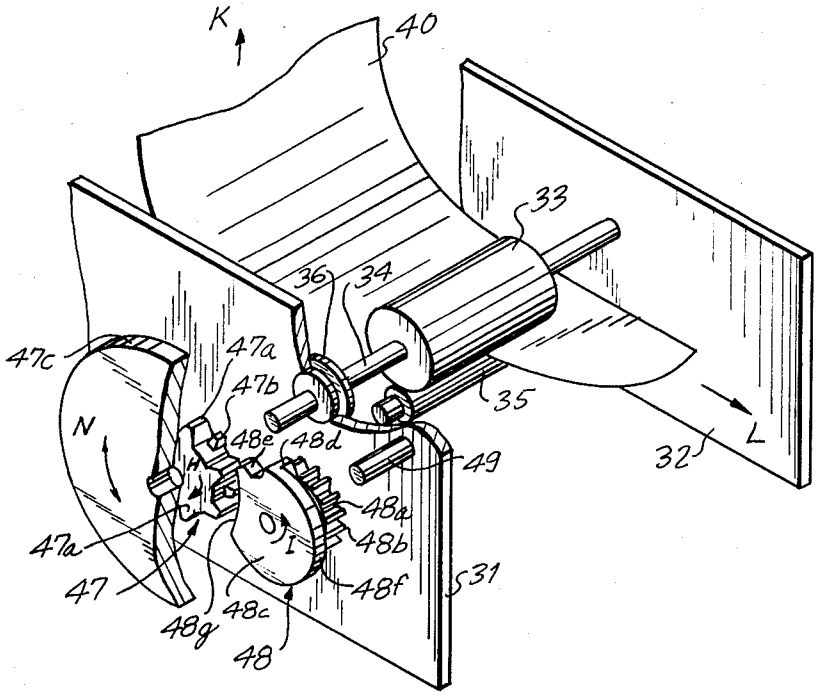
FIG. 13 is a partially exploded perspective view of a paper feeding assembly including a manual feed knob constructed and arranged in accordance with a further embodiment of the invention.

In FIG. 13, an additional embodiment of a paper advance assembly constructed and arranged in accordance with the invention wherein a paper feed gear 47 is formed with a manual paper feed knob section 47*c* is shown in partially exploded perspective. In this embodiment of the invention a paper feed gear 47 is mounted on the end of paper roller shaft 34 outside first side wall 31 of the frame. Paper feed gear 47 is formed with a paper feed knob section 47*c*, a plurality of positioning teeth 47*a* equally spaced about the circumference of paper feed gear 47 and formed across the entire surface thereof and a plurality of paper feed teeth 47*b* formed across a portion of the circumferential surface of paper feed gear 47 equally spaced about the circumference of paper feed gear 47 and positioned alternately between adjacent positioning teeth 47*a*.

Drive gear 48 is mounted on drive shaft 49 which is rotatably mounted on first frame side wall 31 on the opposite side of roller shaft 34 than is drive gear 38 in FIGS. 5 and 12. Drive gear 48 is formed with a first drive section 48*a* formed with a plurality of drive teeth 48*b* equally spaced about the circumference of drive section 48*a*. Drive gear 48 is formed further with a second driving section 48*c* having a larger diameter than first drive section 48*a* and is formed with a first index tooth 48*d* and a second index tooth 48*e* for meshing engagement with one positioning tooth 47*a* or one paper feed tooth 47*b* on paper feed gear 47, a circular positioning cam 48*f* extending about a portion of the circumference of drive gear 48 from first index tooth 48*d* to a concave cam section 48*g* for releasing engagement between drive gear 48 and paper feed gear 47. Circular positioning cam 48*g* is adapted for riding in camming fashion between two adjacent positioning teeth 47*a* adjacent to paper feed tooth 47*b* intermediate these two positioning teeth 47*a*.

Drive gear 48 is rotated in a counter clockwise direction as indicated by an arrow I for rotating paper feed gear 47 in a clockwise direction as shown by an arrow H for advancing paper in a normal advance direction as indicated by an arrow K. Manual feed knob section 47*c* may be displaced manually in either the clockwise or counterclockwise direction as indicated by an arrow N for manual paper advance in normal paper feed direction K or opposite direction L when concave cam 48*g* is opposed to paper feed gear 47. By constructing and arranging drive gear 47 in this manner with manual feed knob section 47*c*, the number of parts required in the assembly may be reduced, thereby resulting in a less expensive paper feed assembly.

Accordingly, by constructing and arranging a paper advance assembly in accordance with the invention as described, print paper can be pulled forwardly and rearwardly easily with minimal force exerted on a print paper. In addition, noise generated by the assembly during manual paper advance is reduced significantly, the lag of the pitch of the print paper is eliminated completely and paper insertion is easier. Moreover, rapid manual extraction of a print paper is made possible, thereby enhancing the marketing potential for a printer including the paper feed assembly of the invention. Further, the paper feed assembly requires a few number of parts which may be easily and accurately assembled making it possible to provide a small reliable and inexpensive printer.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A paper feed assembly in a printer for the incremental advance of a print paper comprising:

paper advance means for selectively incrementally advancing the print paper;

drive means intermittently operatively engaged with said paper advance means for incrementally rotating said paper advance means;

positioning means selectively engageable with said paper advance means for rotating said paper advance means into proper position for said engagement with said drive means for rotation of said paper advance means by said drive means;

said paper advance means including roller means and roller gear means mounted on said roller means for intermittent operative engagement by said drive means, said drive means including drive gear means for intermittently operatively engaging said roller gear means;

said roller means including a roller shaft rotatably mounted on said printer, a paper feed roller mounted on said roller shaft and a support roller rotatably mounted on said printer for compressing said print paper between said support roller and said paper feed roller;

said roller gear means being a paper feed gear formed with a plurality of gear teeth equally spaced about the circumference thereof and mounted on said roller shaft and said drive gear means including a paper drive section formed with at least one index tooth for incrementally rotating said paper feed gear; and said drive gear means further including an auxiliary drive section formed with a plurality of drive teeth about the circumference of said auxiliary drive section and said positioning means including an auxiliary gear means operatively engaged with said auxiliary drive section and formed with reset means for selectively engaging said paper feed gear for rotating said paper feed gear into proper alignment for engagement by said index tooth.

2. The assembly of claim 1, including manual paper advance means mounted on said paper advance means for manually advancing said print paper when said drive means is not engaged with said paper advance means.

3. The assembly of claim 1, including biasing means mounted on said printer for biasing against said roller gear means and displacable between a first position towards said roller gear means for engagement there-with and a second position away from said roller gear means by rotation of said roller gear means for preventing rotation of said roller gear means when not engaged by said drive means.

4. The assembly of claim 1, wherein said auxiliary gear means is a gear formed with a driven section having a plurality of teeth for meshing engagement with said auxiliary drive section of said drive gear means and a positioning section having at least one reset tooth for selectively engaging said paper feed gear for rotating said paper feed gear to a predetermined standby position for engagement with said index tooth on said drive gear means.

5. The assembly of claim 2, including an elongated plate spring formed with a curved portion for biasing against said paper feed gear for preventing rotation of said roller means when said paper feed gear is not engaged by said drive gear means.

6. A paper feed assembly in a printer for the incremental advance of a print paper comprising:

a roller shaft rotatably mounted on said printer;

a paper feed roller mounted on said shaft;

a supporting roller rotatably mounted on said printer and contacting said paper feed roller for feeding said print paper therebetween;

a paper feed gear formed with a plurality of gear teeth fixed to said roller shaft;

a drive gear rotatably mounted on said printer and formed with a drive section having drive teeth and a paper feed section having at least one index tooth for engaging said gear teeth of said paper feed gear;

an auxiliary gear rotatably mounted on said printer and formed with a drive section for operative engagement with said drive teeth of said drive gear and a positioning section formed with at least one reset tooth for selectively engaging one of said gear teeth of said paper feed gear in the rotating locus of said auxiliary gear to a predetermined position; and a positioning spring mounted on said printer and biased against said paper feed gear for maintaining the rotational position of said paper feed gear.

7. A paper feed assembly in a printer for the incremental advance of a print paper comprising:

a frame;

a roller shaft rotatably mounted on said frame;

a paper feed roller mounted on said roller shaft;

a supporting roller rotatably mounted on said frame in contact with said paper feed roller for feeding said print paper therebetween;

a paper feed gear mounted on said roller shaft and formed with a plurality of positioning teeth formed across the entire gearing surface and equally spaced about the circumference thereof and a plurality of paper feed teeth formed across a portion of said gearing surface and equally spaced alternately between adjacent pairs of said positioning teeth; and a drive gear formed with a gearing surface and two index teeth, a circular camming surface formed across a portion of the width of said gearing surface thereof and a portion of said circumference of said drive gear for camming engagement with said paper feed gear between adjacent positioning teeth and a concave cam portion formed in the remaining portion of said circumference of said drive gear for permitting the intermittent disengagement of said drive gear and said paper feed gear.

8. The assembly of claim 7, including a manual advance knob mounted on said roller shaft.

* * * * *